US008512009B2

(12) United States Patent
Wonitoy

(10) Patent No.: US 8,512,009 B2
(45) Date of Patent: Aug. 20, 2013

(54) STEAM DRIVEN PUMP FOR SAGD SYSTEM

(75) Inventor: Kelvin M. Wonitoy, Edmonton (CA)

(73) Assignee: Baker Hughes Incorporated, Houston, TX (US)

( * ) Notice: Subject to any disclaimer, the term of this patent is extended or adjusted under 35 U.S.C. 154(b) by 604 days.

(21) Appl. No.: 12/685,421

(22) Filed: Jan. 11, 2010

(65) Prior Publication Data

US 2011/0171049 A1 Jul. 14, 2011

(51) Int. Cl.
*F04B 17/00* (2006.01)

(52) U.S. Cl.
USPC ..... 417/376; 417/408; 166/105

(58) Field of Classification Search
USPC ..... 417/376, 405, 408, 409; 166/50, 166/52, 62, 68, 105, 106, 272.3, 369
See application file for complete search history.

(56) References Cited

U.S. PATENT DOCUMENTS

| | | | | |
|---|---|---|---|---|
| 2,726,606 | A | 12/1955 | Davisdon | |
| 4,201,060 | A | 5/1980 | Outmans | |
| 4,576,006 | A | 3/1986 | Yamaoka | |
| 5,823,261 | A | 10/1998 | Drumheller | |
| 6,234,770 | B1 | 5/2001 | Ridley et al. | |
| 6,454,010 | B1 * | 9/2002 | Thomas et al. | 166/369 |
| 7,445,049 | B2 * | 11/2008 | Howard et al. | 166/372 |
| 7,448,447 | B2 * | 11/2008 | Walford | 166/250.01 |
| 7,546,870 | B1 * | 6/2009 | Dotson | 166/105 |
| 7,566,208 | B2 | 7/2009 | Santos | |
| 7,814,974 | B2 * | 10/2010 | Sponchia | 166/245 |
| 7,819,190 | B2 * | 10/2010 | Sponchia | 166/272.3 |
| 7,866,385 | B2 * | 1/2011 | Lambirth | 166/256 |
| 2005/0011649 | A1 | 1/2005 | Stewart et al. | |
| 2007/0131415 | A1 * | 6/2007 | Vinegar et al. | 166/245 |
| 2008/0174115 | A1 * | 7/2008 | Lambirth | 290/2 |
| 2009/0272533 | A1 * | 11/2009 | Burns et al. | 166/272.7 |

* cited by examiner

*Primary Examiner* — Charles Freay
*Assistant Examiner* — Ryan Gatzemeyer
(74) *Attorney, Agent, or Firm* — Steve Rosenblatt

(57) ABSTRACT

A downhole pump is operated by a non-electric motor preferably a steam turbine. In a steam assisted gravity drain system the producing well is U-shaped. A steam supply line runs into the turbine that drives the pump after the steam supply passes through a packer. The steam exhaust runs through a shroud until the U-shaped well turns back to go up to the surface. Pump suction is thus separated from steam discharge to reduce mixing as the path of least resistance for the discharged steam when it exits the shroud is up to the surface. The exhaust steam keeps the produced fluids warm and flowing. An injector well runs parallel and slightly above the horizontal portion of the U-shaped producing well.

20 Claims, 1 Drawing Sheet

STEAM DRIVEN PUMP FOR SAGD SYSTEM

FIELD OF THE INVENTION

The field of the invention is a steam driven downhole pump and more particularly when used in a steam assisted gravity drain (SAGD) system for removing viscous fluids that need to be kept warm to flow.

BACKGROUND OF THE INVENTION

Certain applications require pumps to be downhole to boost low borehole pressure so that the fluids produced can be brought to the surface. Some of these applications involve the need to heat the fluid to be produced so that it will flow into the wellbore. Steam assisted gravity drain systems (SAGD) typically heat the formation in a range of about 180 to 300° C. or higher in an injector well that gets the oil less viscous so that it can flow by gravity into an adjacent well below. A pump is located in the well below to bring the oil to the surfaces. Typically these submersible pumps have been driven by an electric motor with a power cable run down to it in the producing well. Electric motors have temperature service limits and operating temperatures in the production well in SAGD systems have gotten high enough as to meet or exceed the service limits of components in electric motors.

Accordingly, there was a need to provide a driver to a downhole motor that can operate at the temperature conditions in such SAGD wells and still produce the required horsepower in a confined wellbore location where space is at a premium. Various pumps in the past have been shown in patents being driven by non-electric motors. Some examples are U.S. Pat. Nos. 2,726,606; 6,234,770; 4,201,060; 4,576,006; US Publication 2005/0011649 and U.S. Pat. No. 5,823,261.

In one case single or stacked stages of steam driven fans are provided on a supply and return headers to drive a downhole pump to bring up well fluids. This reference is U.S. Pat. No. 7,566,208. This reference illustrates certain limitations of the prior art particularly in SAGD application. The illustrated "fans" in this reference will not be able to generate enough power to pump viscous fluids. The running of discrete supply and return headers for the motive fluid, even if it is steam, will not be feasible in many installations due to a simple lack of space.

What is needed is an arrangement that generates the requisite power in the space available and still brings up the produced fluid to the surface. In an SAGD application, the motive fluid keeps the produced fluid warm so that the energy required to bring it to the surface is controlled. Using a unique well configuration system more space is allocated for motive fluid supply and return using a U-shaped well for produced fluid collection and an injector well disposed adjacent and above the U-shaped well. A shroud assembly separates the produced fluid intake from the exhausted motive fluid preferable to the point where the producing well goes vertical so that the path of least resistance for the exhaust motive gasses is uphole. This minimizes the mixing of the produced fluid with the motive fluid. Those skilled in the art will better appreciate more aspects of the invention from a review of the detailed description of the preferred embodiment and the associated drawings while appreciating that the full scope of the invention is determined by the appended claims.

SUMMARY OF THE INVENTION

A downhole pump is operated by a non-electric motor preferably a steam turbine. In a steam assisted gravity drain system the producing well is U-shaped. A steam supply line runs into the turbine that drives the pump after the steam supply passes through a packer. The steam exhaust runs through a shroud until the U-shaped well turns back to go up to the surface. Pump suction is thus separated from steam discharge to reduce mixing as the path of least resistance for the discharged steam when it exits the shroud is up to the surface. The exhaust steam keeps the produced fluids warm and flowing. An injector well runs parallel and slightly above the horizontal portion of the U-shaped producing well.

DETAILED DESCRIPTION OF THE PREFERRED EMBODIMENT

Figure 1:
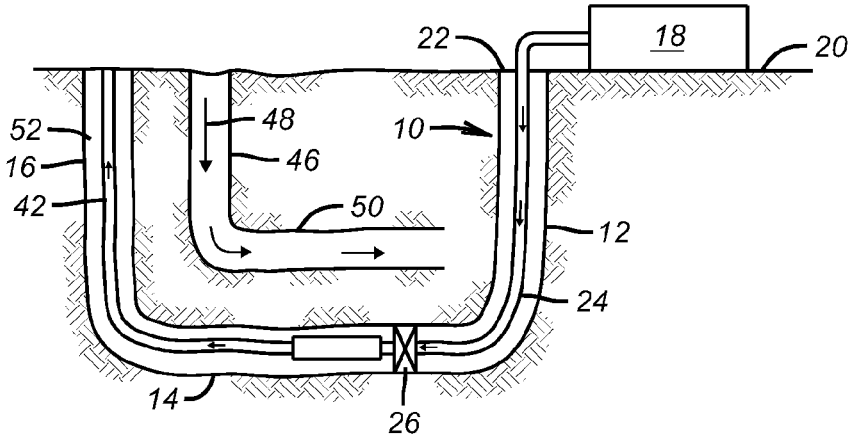
FIG. 1 is a system diagram of the overall assembly.
Figure 2:
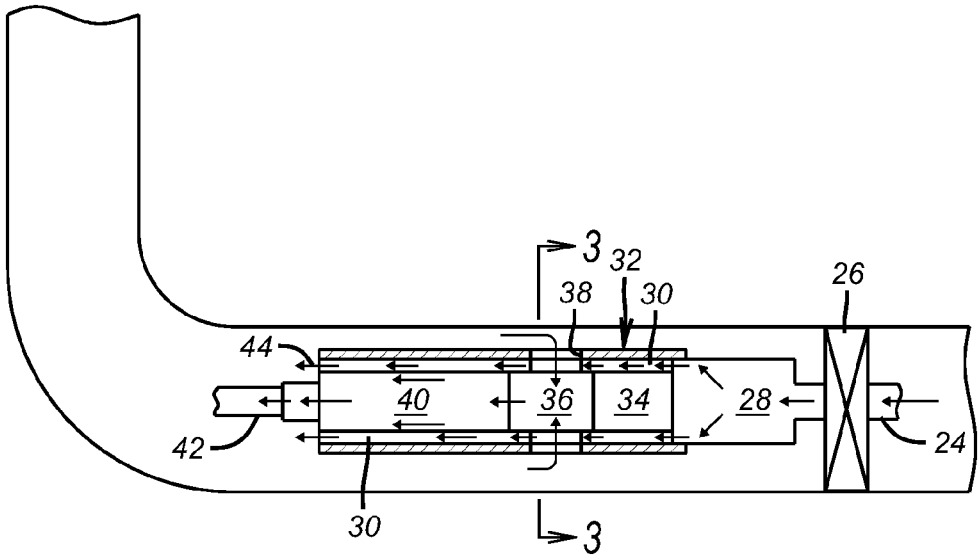
FIG. 2 is a detailed view of the turbine and pump area showing the produced fluid intake flow and the discharged motive fluid flow back to the surface in the producer well.
Figure 3:
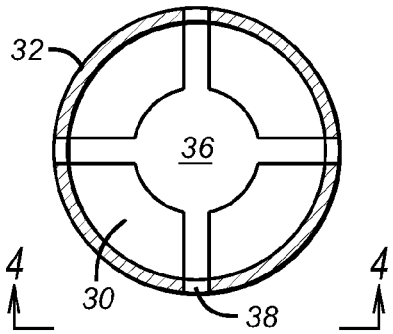
FIG. 3 is a section view along lines 3-3 of FIG. 2.
Figure 4:
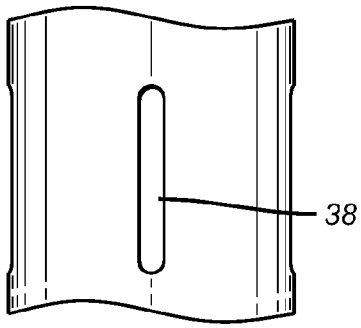
FIG. 4 is an end view along lines 4-4 of FIG. 3.

FIG. 1 illustrates a producer well 10 that is U-shaped having a vertical leg 12 followed by a horizontal run 14 and another vertical rise to the surface 16. A steam plant 18 is at the surface 20 near the wellhead 22. A steam supply line 24 runs in the vertical section 12 and into a packer 26. Continuing on FIG. 2, the steam supply flows into the steam turbine 28 and is exhausted through a series of axial passages 30 that are also shown in section in FIG. 3. The passages 30 are in a shroud 32 that makes room centrally for a thrust module 34 for the turbine blade assembly that is not shown. An intake volume 36 is defined by shroud 32 through preferably oval shaped inlets 38. The steam passages 30 just go past the inlets 38 with no intermixing. Intake space 36 goes into the pump 40 and out the discharge line 42 to the surface 20. Passages 30 continue along the pump 40 as the shroud 32 continues preferably until the vertical well section 16. At that point as represented by arrows 44 the passages 30 and the shroud 32 end releasing the exhausted steam into the vertical bore 16 at a distance remote from the produced fluid inlet 38.

An injector well 46 has steam injected as indicated by arrow 48 such that the steam goes into a horizontal run 50 that runs close and preferably parallel to the horizontal run 14 so that the oil in the heated formation from the injector well 46 gravity drains into the fluid intake 36 through the openings 38. While condensate formed from heating the oil in the injector well 46 can wind up in the produced fluid stream in the discharge line 42 it is easily separated at the surface using known techniques. The exhaust steam from the turbine 28 goes down the lengthy passages 30 to a remote location from the inlets 38 and preferably to a location close to the vertical bore 16 where the exhausted steam and carried condensate has a path of least resistance to the surface in the annulus 52 rather than going the other way to the openings 38 and into pump 40. This leaves more of the capacity of the pump 40 for moving produced fluid that is the bulk of the inlet flow to intake openings 38. The exhausted steam and condensate that returns up the annular space 52 goes back to the steam plant 18 where it is raised back to the required pressure and temperature for the trip back down to the turbine 28.

Those skilled in the art will appreciate that through the use of the U-shaped bore 10 the steam supply runs in a single dedicated bore to the turbine and the exhaust is discharged into an annulus around the production line at a location remote from the produced fluid intake so that the exhausted steam and condensate takes the path of least resistance into the nearby vertical bore back to the surface while at the same time keeping the produced oil warm and flowing. The arrangement can be used in an SAGD process with a nearby injector well.

The above description is illustrative of the preferred embodiment and many modifications may be made by those skilled in the art without departing from the invention whose scope is to be determined from the literal and equivalent scope of the claims below.

I claim:

1. In combination a fluid powered downhole pump in a subterranean location having a motive fluid delivery string from the surface to a fluid driven driver, said motive fluid delivery tubular string extending in a first bore from a first location and exhaust fluid exiting from said driver returning to a different location at the surface through an annular space around a pump discharge line, the annular space defined by a second bore that provides a path of least resistance for said exhaust fluid.

2. The combination of claim 1, wherein:

said pump is located in a third bore that connects said first and second bores.

3. The combination of claim 2, wherein:

said first and second bores are substantially vertical with said third bore being substantially horizontal.

4. The combination of claim 1, wherein:

a barrier between the surface and said fluid driver through which said motive fluid delivery string extends;

said motive fluid comprises steam.

5. The combination of claim 4, wherein:

an injector well running adjacent said downhole pump through which steam is injected to allow production flow toward said pump.

6. The combination of claim 5, wherein:

said pump is located in a third bore that connects said first and second bores;

said first and second bores are substantially vertical with said third bore being substantially horizontal;

said injector well running parallel and adjacent said third bore.

7. The combination of claim 6, wherein:

said pump comprising a production inlet and a production outlet with a production string extending in said second bore from said production outlet to the surface;

said exhaust motive fluid flowing past said inlet in at least one discrete flow path;

said discrete flow path extending axially through a shroud.

8. The combination of claim 7, wherein:

said flow path extends within said shroud and said shroud surrounds said production string;

said flow path and shroud extend to adjacent to said second bore;

said exhaust motive fluid upon exit from said shroud has a path of least resistance to the surface going up said second bore in an annular space around said production string.

9. In combination a fluid powered downhole pump in a subterranean location having a motive fluid delivery string from the surface to a fluid driven driver, said motive fluid delivery string extending in a first bore and exhaust fluid exiting from said driver returning to the surface through a second bore that provides a path of least resistance;

said pump comprising a production inlet and a production outlet with a production string extending in said second bore from said production outlet to the surface.

10. The combination of claim 9, wherein:

said exhaust motive fluid flows past said inlet in at least one discrete flow path.

11. The combination of claim 10, wherein:

said discrete flow path extending axially through a shroud.

12. The combination of claim 11, wherein:

said shroud surrounds said pump.

13. The combination of claim 12, wherein:

said shroud comprises at least one radial passage to said production inlet, said radial passage being discrete from said flow path.

14. The combination of claim 13, wherein:

said flow path extends within said shroud and said shroud surrounds said production string.

15. The combination of claim 14, wherein:

said flow path and shroud extend to adjacent to said second bore.

16. The combination of claim 15, wherein:

said exhaust motive fluid upon exit from said shroud has a path of least resistance to the surface going up said second bore in an annular space around said production string.

17. The combination of claim 16, further comprising:

a barrier between the surface and said fluid driver through which said motive fluid delivery string extends.

18. The combination of claim 17, wherein:

said motive fluid comprises steam.

19. The combination of claim 18, further comprising:

an injector well running adjacent said downhole pump through which steam is injected to allow production flow toward said production inlet.

20. The combination of claim 19, wherein:

said pump is located in a third bore that connects said first and second bores;

said first and second bores are substantially vertical with said third bore being substantially horizontal;

said injector well running parallel and adjacent said third bore.

* * * * *